US008246262B2

(12) United States Patent
Kinoshita et al.

(10) Patent No.: US 8,246,262 B2
(45) Date of Patent: Aug. 21, 2012

(54) PRINT MEDIA PROCESSING APPARATUS AND MEDIA TRANSPORTATION CONTROL METHOD FOR THE SAME

(75) Inventors: Yoshiaki Kinoshita, Hata-machi (JP); Takashi Saikawa, Shiojiri (JP); Atsushi Natsuno, Matsumoto (JP); Masanori Hayashi, Nagawa-machi (JP); Takashi Sunohara, Saku (JP)

(73) Assignee: Seiko Epson Corporation, Tokyo (JP)

( * ) Notice: Subject to any disclaimer, the term of this patent is extended or adjusted under 35 U.S.C. 154(b) by 839 days.

(21) Appl. No.: 11/786,928

(22) Filed: Apr. 13, 2007

(65) Prior Publication Data

US 2007/0243003 A1 Oct. 18, 2007

(30) Foreign Application Priority Data

Apr. 14, 2006 (JP) ..... 2006-112274

(51) Int. Cl.
*B41J 11/00* (2006.01)

(52) U.S. Cl. ..... 400/582; 400/596

(58) Field of Classification Search ..... 400/596, 400/582

See application file for complete search history.

(56) References Cited

U.S. PATENT DOCUMENTS

| | | | | | |
|---|---|---|---|---|---|
| 5,583,783 | A * | 12/1996 | Yasui | 700/213 |
| 5,602,571 | A * | 2/1997 | Suda et al. | 346/134 |
| 5,800,074 | A * | 9/1998 | Hayama | 400/76 |
| 5,864,774 | A * | 1/1999 | Jones | 702/94 |
| 6,095,703 | A * | 8/2000 | Tanaka et al. | 400/582 |
| 6,257,783 | B1 * | 7/2001 | Hanaoka et al. | 400/578 |
| 6,471,351 | B1 * | 10/2002 | Ishikawa et al. | 347/104 |
| 6,481,624 | B1 * | 11/2002 | Hayduchok | 235/449 |
| 7,090,131 | B2 | 8/2006 | Natsuno | |
| 7,101,096 | B2 | 9/2006 | Sasai et al. | |
| 2001/0024590 | A1 * | 9/2001 | Woodman et al. | 400/613 |
| 2002/0001499 | A1 * | 1/2002 | Hayashi et al. | 400/582 |
| 2003/0075596 | A1 * | 4/2003 | Koakutsu | 235/379 |
| 2003/0174874 | A1 * | 9/2003 | Raterman et al. | 382/135 |
| 2006/0043182 | A1 * | 3/2006 | Kinoshita | 235/449 |
| 2006/0171759 | A1 | 8/2006 | Kinoshita et al. | |
| 2006/0231621 | A1 | 10/2006 | Natsuno | |

FOREIGN PATENT DOCUMENTS

| | | | |
|---|---|---|---|
| JP | 07314815 | A | 12/1995 |
| JP | 2002-127518 | A | 5/2002 |
| JP | 2005-228246 | | 8/2005 |

* cited by examiner

*Primary Examiner* — Anthony Nguyen

(74) *Attorney, Agent, or Firm* — Nutter McClennen & Fish LLP; John J. Penny, Jr.; Rory P. Pheiffer

(57) ABSTRACT

A print media processing apparatus increases printer throughput by starting printing after setting the conveyed print medium to the printing start position, and a transportation control unit controls how far the print medium is advanced according to the length of text to be printed on the print medium. The transportation control unit advances the paper to the position where printing text of a specified length to the printing area of the paper begins.

6 Claims, 7 Drawing Sheets

PRINT MEDIA PROCESSING APPARATUS AND MEDIA TRANSPORTATION CONTROL METHOD FOR THE SAME

This application claims priority under 35 U.S.C. §119 from Japanese Patent Application 2006-112274 filed on Apr. 14, 2006, which is hereby incorporated by reference in its entirety.

BACKGROUND OF THE INVENTION

1. Technical Field

The present invention relates to a print media processing apparatus having a printing function and to a media transportation control method for the print media processing apparatus.

2. Related Art

Printers having a function for printing to slips such as personal and business checks are known. Magnetic ink characters and images may be printed on such checks, and multifunction printers having a magnetic ink character reader (MICR) and image scanner disposed along the media transportation path for reading the magnetic ink character information and imaging the checks before printing on either or both sides of the check are also known. To print on a slip, the slip is held stationary at the printing position while the carriage is moved to print. See, for example, Japanese Unexamined Patent Appl. Pub. JP-A 2005-228246. Note that printing as used herein includes printing text and graphics.

Slips such as personal checks, business checks, and bank checks may vary in length, but regardless of the length of the slip, printing usually starts with the trailing end of the slip set to the standby position of the carriage after the magnetic ink character reading and imaging processes are completed.

Processed slips thus include forms of different lengths, and the size of the printing area on the slips also differs according to the type of form. Business checks, for example, are typically longer than personal checks, and the printing area measured along the length of the check is therefore also longer. The carriage typically prints while moving from the right edge to the left edge of the printing area, and printing does not necessarily fill all of the printing area. For example, if the print data printed on a personal check is printed with left justification on a business check, only a portion of the printing area on the business check may be printed on and printing does not actually start until after the carriage is moved.

When only a portion of the printing area is printed on, printers of the related art that start printing after setting the trailing end of the slip to the standby position of the print head regardless of the slip size must therefore move the carriage to the position where printing actually starts before starting to print, which increases the delay until printing starts.

In addition, because the trailing end of the slip is positioned at the standby position of the carriage regardless of the type of slip, business checks that are longer than personal checks must be transported farther than personal checks before printing can start. If only a portion of the printing area on the business check is to be printed, however, it is not necessary to position the trailing end of the slip to the stand by position of the carriage. It is sufficient to set the position from where printing actually starts to the standby position of the carriage. Therefore, transporting the check the difference in the length of the slips is therefore wasted effort.

Printers of the related art that start printing after setting the trailing end of all slips to the standby position of the carriage regardless of slip length or type thus suffer from a longer delay until printing starts, waste time and effort conveying forms, and thus inhibit achieving higher printer throughput.

SUMMARY

The present invention is directed to solving these problems and increasing the printing speed.

More particularly, the invention changes the position of the form that is set to the printing start position according to the length of the text to be printed. As a result, printing can start immediately without needing to move the carriage to the actual printing start position when all of the printing area on a particular form is not used for printing, and printing can therefore proceed more quickly.

MICR and image scanning operations that precede printing can also be executed reliably.

In addition, changing the position where the form is set for printing does not cause a paper jam to be falsely detected because the leading end of the form is advanced to the paper detector located near the exit at the discharge unit. Whether the slip being conveyed through the transportation path has jammed or not can also be detected.

A print media processing apparatus according to a first preferred aspect of the invention repeatedly reads image information and magnetic ink information from a plurality of slips by an image scanning unit and a magnetic ink reading unit, prints using a print head at a fixed printing position downstream from the magnetic ink reading unit and the image scanning unit, and consecutively conveys each of the plurality of slips by a transportation mechanism. The transportation mechanism conveys the print medium at a constant speed when feeding a slip through the print media processing apparatus to read the image information and magnetic ink information and print on the slip. Origin O is the position of the trailing end of the slip at the position where both the magnetic ink reading unit and the image scanning unit have read to the trailing end of the conveyed slip; b−c is the length of the printing area of the slip (and b>c when the trailing end of the slip is at the origin O); and d is the position of the print head. When c<d, the transportation mechanism stops slip transportation after advancing the slip distance d−c after the trailing end of the slip reaches the origin O, and then advances the next slip into the print media processing apparatus; and when c>=d, the transportation mechanism stops slip transportation when the trailing end of the slip reaches the origin O, and then advances the next slip into the print media processing apparatus.

A print media processing apparatus according to another preferred aspect of the invention repeatedly reads image information and magnetic ink information from a plurality of slips by using an image scanning unit and a magnetic ink reading unit, prints by using a print head at a fixed printing position downstream from the magnetic ink reading unit and the image scanning unit, and consecutively conveys each of the plurality of slips by a transportation mechanism. The transportation mechanism conveys the print medium at a constant speed when feeding a slip through the print media processing apparatus to read the image information and magnetic ink information and print on the slip. Origin O is the position of the trailing end of the slip at the position where both the magnetic ink reading unit and the image scanning unit have read to the trailing end of the conveyed slip; a is the position of the leading end of the slip in the transportation direction (when the trailing end of the slip is at the origin); b−c is the length of the printing area of the slip (and a>b>c when the trailing end of the slip is at the origin O); d is the position of the print head; and e is the position of the discharge detector. When c>=d and e>a, the transportation mechanism stops slip transportation after advancing the slip distance e−a after the trailing end of the slip reaches the origin O, and then advances the next slip into the print media processing apparatus; when c>=d and e<=a, the transportation mechanism stops slip transportation when the trailing end of the slip reaches the origin O, and then advances the next slip into the print media processing apparatus; when c<d and e>a+(d−c), the transportation mechanism stops slip transportation after advancing the slip distance e−(a+(d−c)) after the trailing end of the slip reaches the origin O, and then advances the next slip into the print media processing apparatus; and when c<d and e<=a+(d−c), the transportation mechanism stops slip transportation after advancing the slip distance d−c after the trailing end of the slip reaches the origin O, and then advances the next slip into the print media processing apparatus.

Another preferred aspect of the invention is a media transportation control method for a print media processing apparatus for repeatedly reading image information and magnetic ink information from a plurality of slips using an image scanning unit and a magnetic ink reading unit, printing using a print head at a fixed printing position downstream from the magnetic ink reading unit and the image scanning unit, and consecutively conveying each of the plurality of slips by a transportation mechanism. The transportation mechanism conveys the print medium at a constant speed when feeding a slip through the print media processing apparatus to read the image information and magnetic ink information and print on the slip. Origin O is the position of the trailing end of the slip at the position where both the magnetic ink reading unit and the image scanning unit have read to the trailing end of the conveyed slip; b−c is the length of the printing area of the slip (and b>c when the trailing end of the slip is at the origin O); and d is the position of the print head. The media transportation control method includes the following steps: when c<d, advancing the slip distance d−c after the trailing end of the slip reaches the origin O, then stopping slip transportation, and then advancing the next slip into the print media processing apparatus; and when c>=d, stopping slip transportation when the trailing end of the slip reaches the origin O, and then advancing the next slip into the print media processing apparatus.

Another preferred aspect of the invention is a media transportation control method for a print media processing apparatus for repeatedly reading image information and magnetic ink information from a plurality of slips using an image scanning unit and a magnetic ink reading unit, printing by using a print head at a fixed printing position downstream from the magnetic ink reading unit and the image scanning unit, and consecutively conveying each of the plurality of slips by a transportation mechanism. The transportation mechanism conveys the print medium at a constant speed when feeding a slip through the print media processing apparatus to read the image information and magnetic ink information and print on the slip. Origin O is the position of the trailing end of the slip at the position where both the magnetic ink reading unit and the image scanning unit have read to the trailing end of the conveyed slip; a is the position of the leading end of the slip in the transportation direction (when the trailing end of the slip is at the origin) ; b−c is the length of the printing area of the slip (and a>b>c when the trailing end of the slip is at the origin O); d is the position of the print head; and e is the position of the discharge detector. The media transportation control method includes the following steps: when c>=d and e>a, stopping slip transportation after advancing the slip distance e−a after the trailing end of the slip reaches the origin O, and then advancing the next slip into the print media processing apparatus; when c>=d and e<=a, stopping slip transportation when the trailing end of the slip reaches the origin O, and then advancing the next slip into the print media processing apparatus; when c<d and e>a+(d−c), stopping slip transportation after advancing the slip distance e−(a+(d−c)) after the trailing end of the slip reaches the origin O, and then advancing the next slip into the print media processing apparatus; and when c<d and e<=a+(d−c), stopping slip transportation after advancing the slip distance d−c after the trailing end of the slip reaches the origin O, and then advancing the next slip into the print media processing apparatus.

The invention changes the position of the form that is set to the printing start position according to the length of the text to be printed. As a result, printing can start immediately without needing to move the carriage to the actual printing start position when all of the printing area on a particular form is not used for printing, and printing can therefore proceed more quickly.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of the present invention are described below with reference to the accompanying figures.

Figure 1:
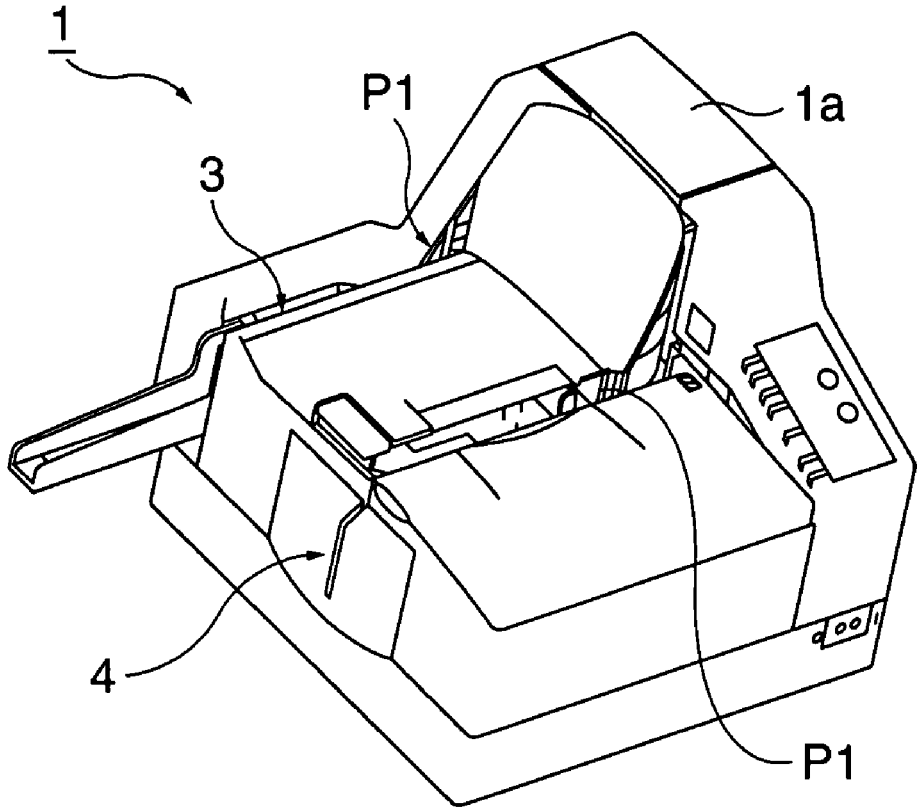
FIG. 1 is an oblique view of a hybrid processing apparatus used to describe the print media processing apparatus and the print media processing apparatus control method according to a preferred embodiment of the invention.
Figure 2:
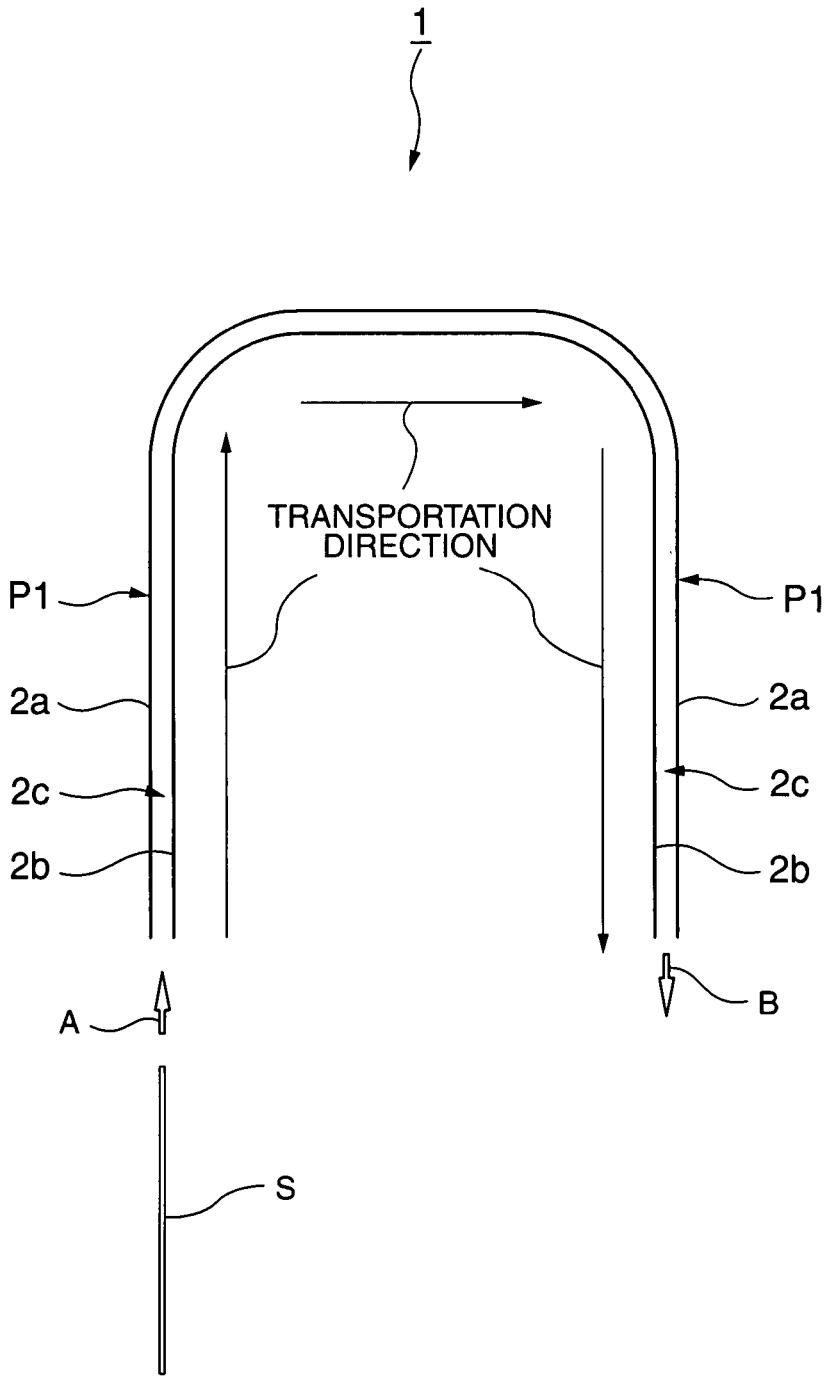
FIG. 2 is a top view of the media transportation path in the hybrid processing apparatus shown in FIG. 1.
Figure 3:
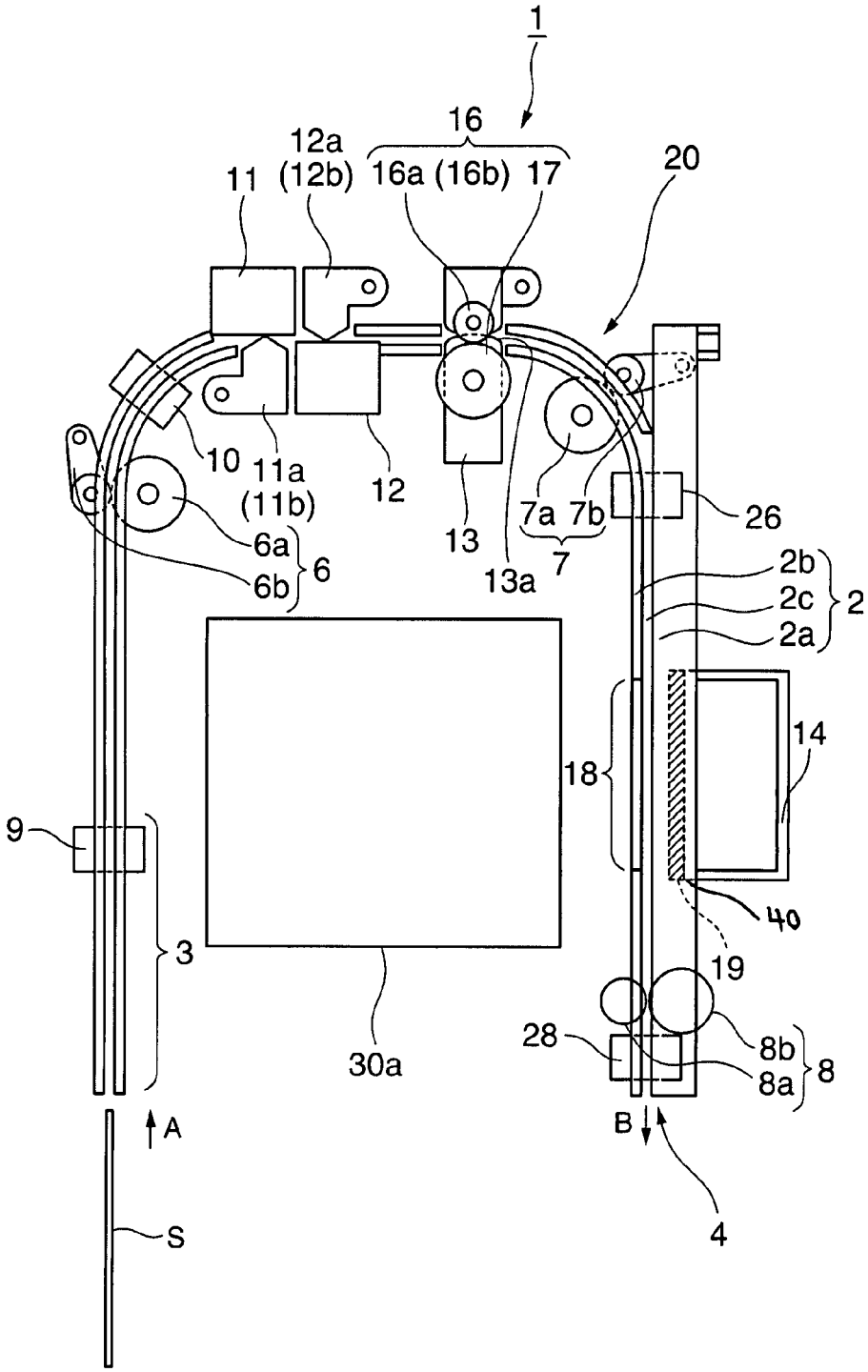
FIG. 3 is a schematic top view showing the internal arrangement of the hybrid processing apparatus shown in FIG. 1.

As shown in FIG. 1 to FIG. 3, the hybrid processing apparatus 1 according to this embodiment of the invention can scan a slip S, read magnetic ink characters on the slip S, print on the slip S as slips S loaded in an automatic sheet feeder (ASF) 3 (paper supply unit) are conveyed through a paper transportation path P1 that is formed in the printer case 1*a*, and then discharge the slip S from the paper exit 4.

A transportation unit disposed in the paper transportation path Pi for conveying slips includes paper transportation rollers 6, middle transportation rollers 16, second transportation rollers 7, and discharge rollers 8 before the paper exit 4.

The paper transportation rollers 6 include a drive roller 6*a* on one side of the paper transportation path P1 and a pressure roller 6*b* disposed on the other side of the paper transportation path P1 opposite the drive roller 6*a*.

The second transportation rollers 7 include a drive roller 7*a* on one side of the paper transportation path P1 and a pressure roller 7*b* disposed on the other side of the paper transportation path P1 opposite the drive roller 7*a*.

The middle transportation rollers 16 include a bottom pressure roller 16*a* disposed at the lower part of the paper transportation path P1, an upper pressure roller 16*b* disposed at the upper part of the paper transportation path P1, and a drive roller 17 opposing the bottom pressure roller 16*a* and upper pressure roller 16*b* from the other side of the transportation path.

A slip S fed into the paper transportation path P1 by the ASF 3 is conveyed by the paper transportation rollers 6, the middle transportation rollers 16, and the second transportation rollers 7, and is then discharged in the direction of arrow B from the paper exit 4 by the discharge rollers 8.

Image scanners 11 and 12 for imaging the slips are disposed in the paper transportation path at offset positions along the transportation direction. Both image scanners 11 and 12 are CIS (contact image sensor) scanners.

The image scanners 11 and 12 each expose one side of the slip travelling through the transportation path to light, detect the light reflected from the slip by a photoreceptor array (an array of photoelectric conversion devices), and convert the detected light to electric signals to capture an image of the slip.

A magnetic ink character reading device (MICR) 13 for reading magnetic ink characters is disposed below the drive roller 17. The MICR 13 reads while the surface of the slip S is pressed against the surface of the MICR 13 by a pressure lever disposed opposite the MICR 13 on the other side of the transportation path.

The carriage 14 is disposed in the straight portion of the paper transportation path P1 between the second transportation rollers 7 and the discharge rollers 8 so that the carriage 14 can move linearly along the paper transportation path P1. A print head 19 having a plurality of nozzles for discharging ink is disposed on the carriage 14. Ink is discharged from the plurality of nozzles of the print head 19 in response to commands from the host computer 110 to print. The carriage 14 can move along a guide shaft disposed at this straight portion of the transportation path parallel to the transportation direction of the paper transportation path P1.

Four paper detectors are disposed in the paper transportation path P1, including the ASF detector (paper supply unit detector) 9, TOF (top of form) detector 10, validation slip detector 26, and discharge detector 28. These detectors 9, 10, 26, and 28 are optical paper detectors, for example, rendered to detect the presence of paper in front of the detector.

The ASF detector 9 is disposed near the discharge side end of the ASF 3 to detect a slip delivered from the ASF 3.

The TOF detector 10 is disposed between the ASF 3 and the image scanner 11 for detecting media delivered to the first image scanner 11.

The validation slip detector 26 is disposed in the straight portion on the downstream side of the second transportation rollers 7, and detects if a validation slip is inserted from the validation slip insertion slot 40.

The discharge detector 28 is disposed near the paper exit 4 and detects each slip discharged from the paper exit 4.

Figure 4:
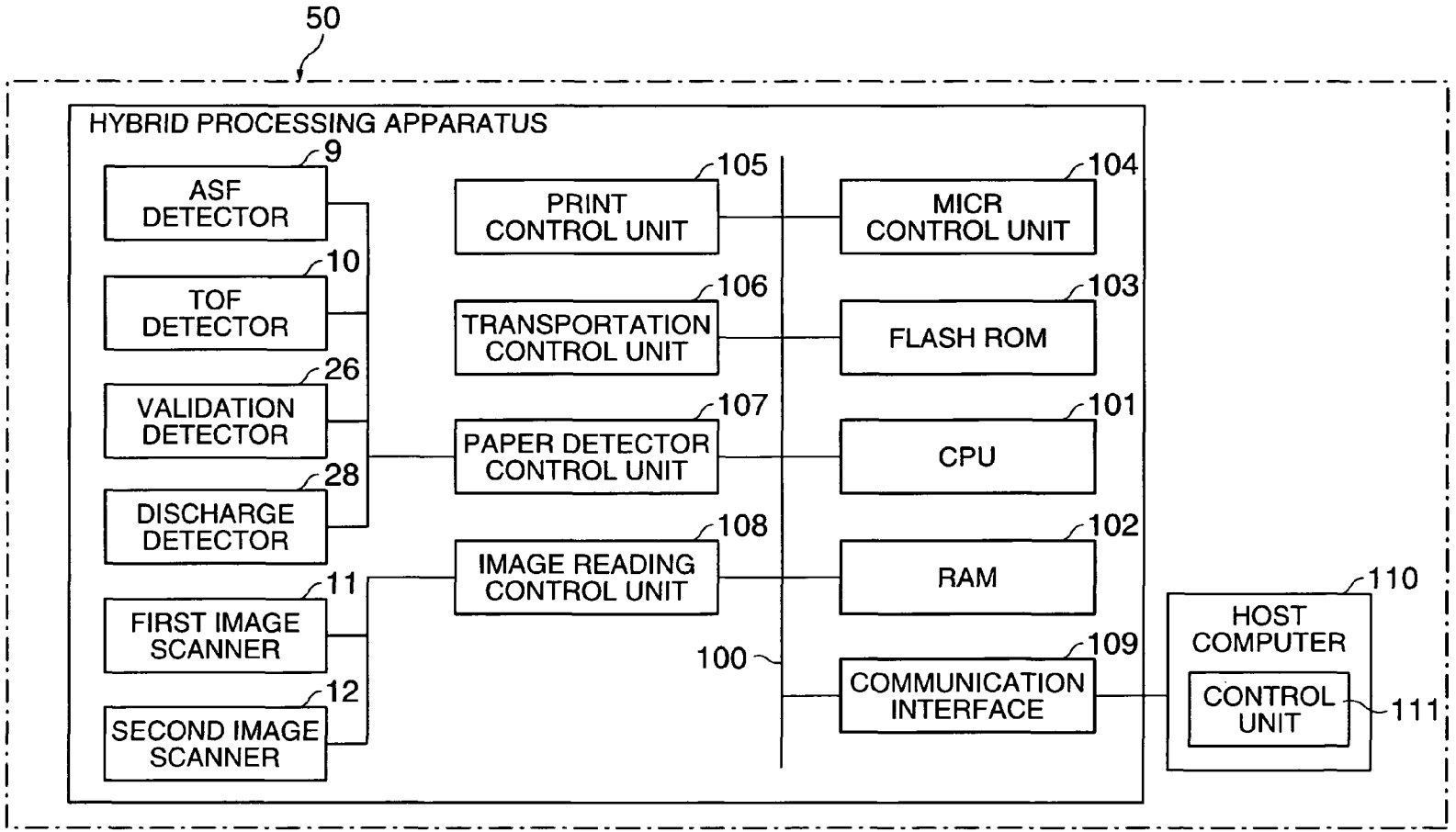
FIG. 4 is a control block diagram of the print media processing apparatus (hybrid processing apparatus) according to the present invention.

FIG. 4 is a control block diagram of the print media processing system 50 according to this embodiment of the invention.

The print media processing system 50 includes a host computer 110 and a hybrid processing apparatus 1 that is communicably connected to the host computer 110.

The host computer 110 has a control unit 111 and controls general operation of the print media processing system 50. In this aspect of the invention the control unit 111 interprets magnetic ink character data and image data sent from the hybrid processing apparatus 1 and determines if the MICR 13 and image scanners 11 and 12 are operating normally. The control unit 111 generates a command based on the result of this determination and outputs the command to the print media processing apparatus 1.

The hybrid processing apparatus 1 has a CPU 101, RAM 102, flash ROM 103, a MICR control unit 104, a print control unit 105, a transportation control unit 106, a paper detector control unit 107, a image reading control unit 108, and a communication interface 109 interconnected by a bus 100 to enable data communication.

The CPU 101 is the control center of the hybrid processing apparatus 1 and controls overall operation of the hybrid processing apparatus 1 by running firmware stored in flash ROM 103 in response to commands from the host computer 110.

The RAM 102 is volatile memory provided as temporary storage for the hybrid processing apparatus 1, and functions as a data buffer for CPU 101 operations, a receive buffer for temporarily storing commands sent form the host computer 110, an image data buffer for temporarily storing image data captured by the image scanners 11 and 12 and magnetic ink character data read by the MICR 13, and a print buffer for storing the converted image data for printing.

The flash ROM 103 is rewritable non-volatile memory provided as a data storage area for the hybrid processing apparatus 1, and primarily stores the firmware run by the CPU 101 and settings for the hybrid processing apparatus 1. The CPU 101 controls the hybrid processing apparatus 1 by running the firmware stored in this flash ROM 103 using the settings (parameters) stored in the same flash ROM 103.

The MICR control unit 104 is a driver for controlling driving of the MICR 13. More specifically, the MICR control unit 104 generates a read sampling pulse that is output to the MICR 13 in response to commands from the CPU 101, and sends a digital signal representing the magnetic ink characters read by the MICR 13 to the RAM 102. The magnetic ink character data printed on the slip S is thus stored in RAM 102. The magnetic ink character data is then sequentially output to the host computer 110, and the control unit 111 determines if the data was read correctly.

The print control unit 105 is a driver for controlling driving of the carriage 14 and the print head 19. More specifically, the print control unit 105 drives the print head 19 while driving the carriage 14 according to the print data to discharge ink from the print head 19 onto the slip and form an image on the print medium.

The transportation control unit 106 is a driver for controlling the conveying of slips. To-convey a slip, the transportation control unit 106 drives a stepping motor (not shown in the figure) to drive the ASF 3 and transportation rollers 6, 7, 8 and 16 to carry the slip through the paper transportation path P1. In this embodiment of the invention the transportation control unit 106 also controls the position of the slip that is set to the printing start position according to the type of slip.

Figure 5A:
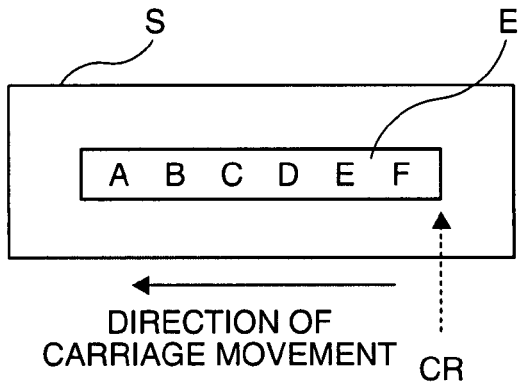
FIGS. 5A and 5B schematically describes the arrangement of a slip and positioning the slip relative to the carriage.
Figure 5B:
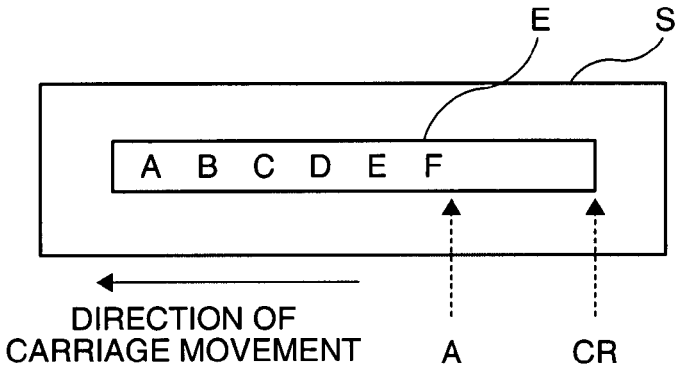

As shown in FIGS. 5A and 5B, the printing area E is provided lengthwise to the slip S, but because the length of the printing area E parallel to the length of the slip is different on personal checks (FIG. 5A) and business checks (FIG. 5B), the printing area E on a business check is longer than the printing area E on a personal check. The carriage that waits at the printing start position (CR) prints while moving to the left as seen in the figure. When all of the printing area is not used for printing and white space is left at the end portion of the printing area as shown in FIG. 5B, however, the carriage must be moved to the position indicated by arrow A where actual printing starts before printing can start. This embodiment of the invention sets the slip to the actual printing start position (indicated by arrow A in FIG. 5B) for printing the specified length of text so that printing can start immediately without moving the carriage at the beginning of the printing process even when white space is left in the printing area.

Note that when magnetic ink character reading or image scanning precede printing, the slip must be conveyed to the position where these reading operations end. The slip must also be conveyed until the leading end of the slip is detected by the discharge detector so that paper jams can also be detected.

The paper detector control unit 107 is a detector driver for driving the ASF detector 9, the TOF detector 10, the validation slip detector 26, and the discharge detector 28. More specifically, the paper detector control unit 107 produces the media detection sampling pulses that are output to the detectors 9, 10, 26, and 28.

The image reading control unit 108 is an image scanner driver for controlling the image scanners 11 and 12. More specifically, the image reading control unit 108 outputs a scanning trigger signal to the image scanners 11 and 12, A/D converts the electric signals output by the photodetectors of the image scanners 11 and 12, and outputs the converted signals to the RAM 102. A two-dimensional image of the slip is thus gradually assembled in RAM 102. The resulting image data is then sent to the host computer 110, and the control unit 111 determines if the image data was correctly read.

The communication interface 109 is the communication control unit for communicating with the host computer 110, and may be implemented using a USB interface or a serial interface, for example. The communication interface 109 passes commands sent from the host computer 110 to RAM 102, and passes status signals (signals indicating the state of the hybrid processing apparatus 1) generated by the CPU 101, the magnetic ink character data, and image data to the host computer 110.

Figure 6:
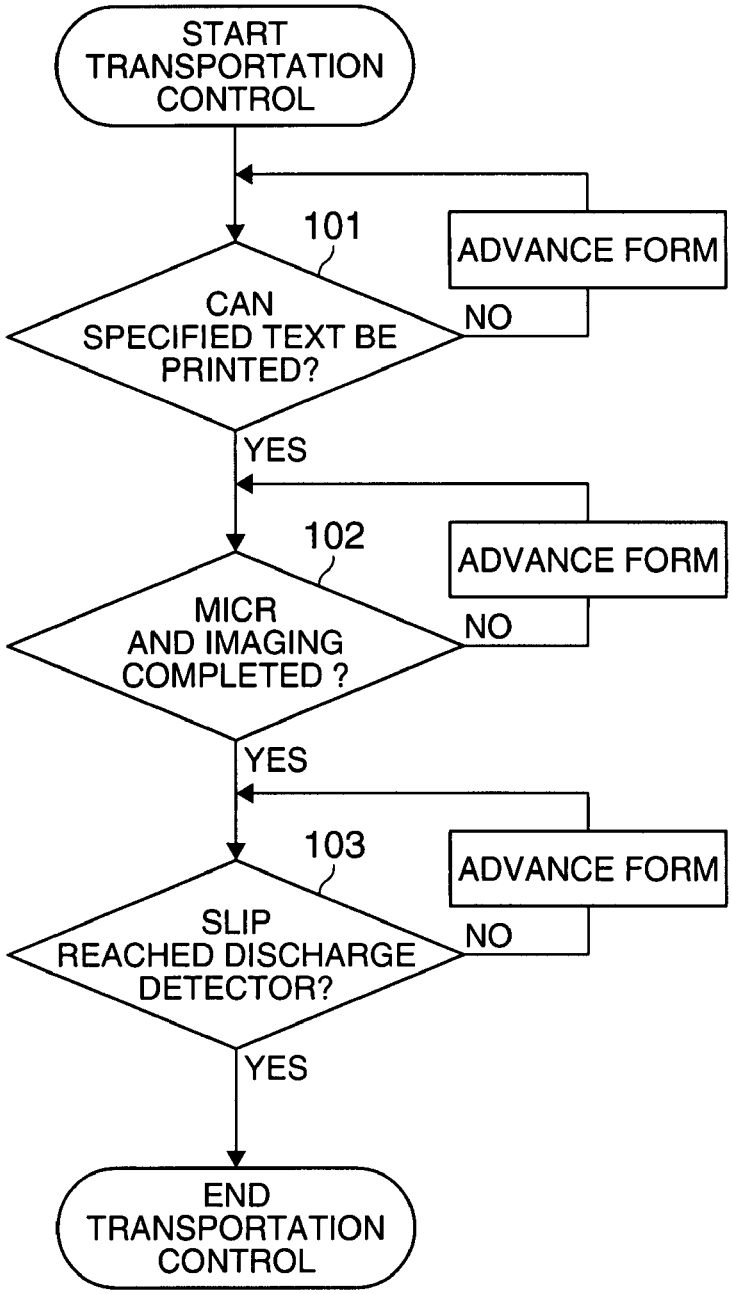
FIG. 6 is a flow chart describing the operation of the transportation control unit.

FIG. 6 is a flow chart of the process run by the transportation control unit 106, and describes the process for setting a slip to the printing position.

The transportation control unit 106 first determines if the specified length of text can be printed in the printing area of the slip (S101) and advances the slip until the slip is set to the position where the specified text can be printed. If MICR and image scanning operations are not completed at this position (S102), the slip is advanced to the position where MICR and image scanning operations can be completed. If at this position the leading end of the slip has not reached the discharge detector 28 (S103), the slip is advanced until the leading end of the slip reaches the discharge detector 28.

This embodiment of the invention can thus change the position of the slip being set to the printing start position according to the length of text to be printed. As a result, printing can start immediately without moving the carriage to the actual printing start position when printing does not fill the available printing area of the slip, and printer throughput can therefore be increased.

Figure 7:
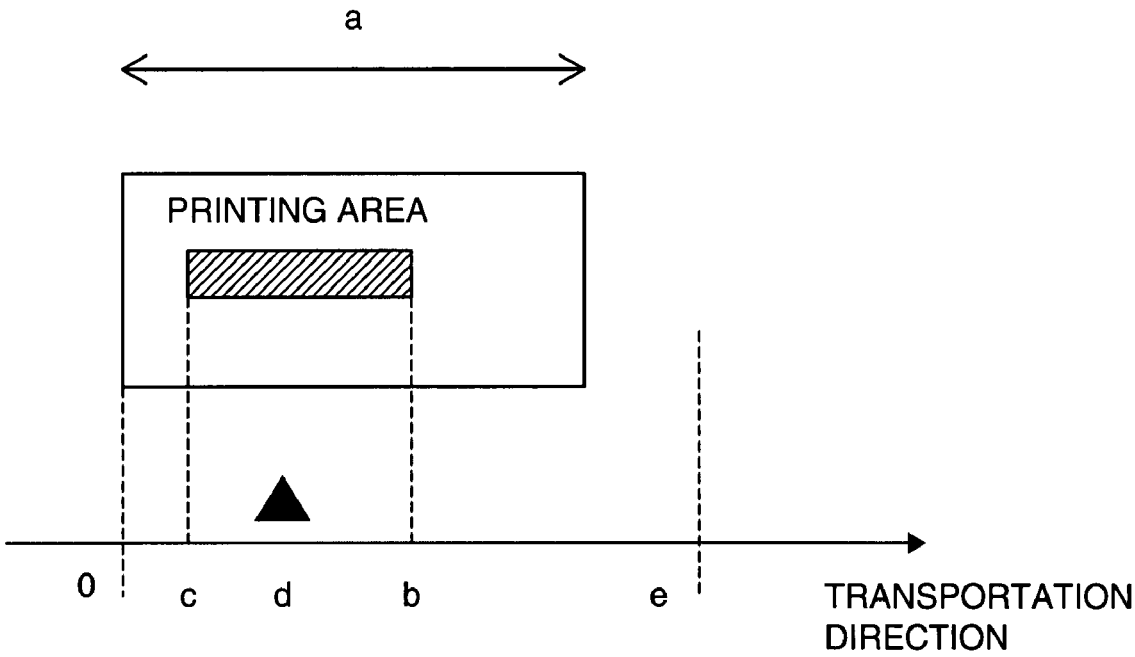
FIG. 7 is a schematic diagram describing paper transportation control.

FIG. 7 describes controlling slip transportation.

In a hybrid processing apparatus for repeatedly printing by using a print head 9 at a fixed printing position downstream from an MICR 13 and image scanners 11 and 12, and consecutively conveying each of a plurality of slips by a transportation mechanism, the transportation control unit 106 conveys the print medium at a constant speed when feeding a slip through the hybrid processing apparatus to read the image information and magnetic ink information and print on the slip. Referring to FIG. 7, origin O is the position of the trailing end of the slip at the position where both the MICR 13 and image scanners 11 and 12 have read to the trailing end of the conveyed slip; b−c is the length of the printing area of the slip (and b>c when the trailing end of the slip is at the origin O); d is the position of the print head. When c<d, the transportation control unit 106 stops slip transportation after advancing the slip distance d−c after the trailing end of the slip reaches the origin O, and then advances the next slip into the hybrid processing apparatus; and when c>=d, the transportation control unit 106 stops slip transportation when the trailing end of the slip reaches the origin O, and then advances the next slip into the hybrid processing apparatus.

In a hybrid processing apparatus according to another preferred aspect of the invention, the transportation control unit 106 conveys the print medium at a constant speed when feeding a slip through the hybrid processing apparatus to read the image information and magnetic ink information and print on the slip. Referring to FIG. 7, origin O is the position of the trailing end of the slip at the position where both the MICR 13 and image scanners 11 and 12 have read to the trailing end of the conveyed slip; a is the position of the leading end of the slip in the transportation direction (when the trailing end of the slip is at the origin); b−c is the length of the printing area of the slip (and a>b>c when the trailing end of the slip is at the origin O); d is the position of the print head 9; and e is the position of the discharge detector 28. When c>=d and e>a, the transportation control unit 106 stops slip transportation after advancing the slip distance e−a after the trailing end of the slip reaches the origin O, and then advances the next slip into the hybrid processing apparatus; when c>=d and e<=a, the transportation control unit 106 stops slip transportation when the trailing end of the slip reaches the origin O, and then advances the next slip into the hybrid processing apparatus; when c<d and e>a+(d−c), the transportation control unit 106 stops slip transportation after advancing the slip distance e−(a+(d−c)) after the trailing end of the slip reaches the origin O, and then advances the next slip into the hybrid processing apparatus; and when c<d and e<=a+(d−c), the transportation control unit 106 stops slip transportation after advancing the slip distance d−c after the trailing end of the slip reaches the origin O, and then advances the next slip into the hybrid processing apparatus.

Although the present invention has been described in connection with the preferred embodiments thereof with reference to the accompanying drawings, it is to be noted that various changes and modifications will be apparent to those skilled in the art. Such changes and modifications are to be understood as included within the scope of the present invention as defined by the appended claims, unless they depart therefrom.

What is claimed is:

1. A media transportation control method for a print media processing apparatus for repeatedly reading image information and magnetic ink information from a plurality of slips by an image scanning unit and a magnetic ink reading unit, printing by a print head at a fixed printing position downstream from the magnetic ink reading unit and the image scanning unit, and consecutively conveying each of the plurality of slips by a transportation mechanism, wherein:

the transportation mechanism conveys the print medium at a constant speed when feeding a slip through the print media processing apparatus to read the image information and magnetic ink information and print on the slip;

origin O is the position of a trailing end of the slip at the position where both the magnetic ink reading unit and the image scanning unit have read to the trailing end of the conveyed slip;

c represents a distance between an end of a printing area of the slip and the origin O;

b represents a distance between a start of the printing area and the origin O, b being more distal of the origin O than c;

b−c is the length of the printing area of the slip;

d is a distance between a fixed printing position of the print head and the origin O; and the media transportation control method comprises steps of:

operating at least one of the magnetic ink reading unit and the image scanning unit to determine a length of the printing area;

operating the print head to print on the slip such that printing on the slip starts when b=d and stops when c=d; and operating the transportation mechanism in one of the following manners:

if c is less than d, advancing the slip distance d−c after the trailing end of the slip reaches the origin O to allow the print head to finish printing on the slip such that c=d, then stopping slip transportation; and if c is greater than or equal to d, stopping slip transportation when the trailing end of the slip reaches the origin O.

2. A media transportation control method for a print media processing apparatus for repeatedly reading image information and magnetic ink information from a plurality of slips by an image scanning unit and a magnetic ink reading unit, printing by a print head at a fixed printing position downstream from the magnetic ink reading unit and the image scanning unit, and consecutively conveying each of the plurality of slips by a transportation mechanism, wherein:

the transportation mechanism conveys the print medium at a constant speed when feeding a slip through the print media processing apparatus to read the image information and magnetic ink information and print on the slip;

origin O is the position of a trailing end of the slip at the position where both the magnetic ink reading unit and the image scanning unit have read to the trailing end of the conveyed slip;

a represents a distance between a leading end of the slip in the transportation direction and the origin O when the trailing end of the slip is at the origin O;

c represents a distance between an end of a printing area of the slip and the origin O;

b represents a distance between a start of the printing area and the origin O, b being more distal of the origin O than c;

b−c is the length of the printing area of the slip;

d is a distance between a fixed printing position of the print head and the origin O;

e represents a distance between the discharge detector and the origin O; and the media transportation control method comprises steps of:

operating at least one of the magnetic ink reading unit and the image scanning unit to determine a length of the printing area;

operating the print head to print on the slip such that printing on the slip starts when b=d and stops once c=d; and operating the transportation mechanism in one of the following manners:

if c is greater than or equal to d and e is greater than a, advancing the slip distance e−a after the trailing end of the slip reaches the origin O to allow the leading end of the slip to reach the discharge detector, then stopping slip transportation;

if c is greater than or equal to d and e is less than or equal to a, stopping slip transportation when the trailing end of the slip reaches the origin O;

if c is less than d and e is greater than a+(d−c) with the trailing end of the slip at the origin O, advancing the slip distance e−(a+(d−c)) after the trailing end of the slip reaches the origin O to allow the print head to finish printing on the slip such that c=d and then to allow the leading end of the slip to reach the discharge detector, and then stopping slip transportation; and if c is less than d and e is less than or equal to a +(d−c) with the trailing end of the slip at the origin O, advancing the slip distance d−c after the trailing end of the slip reaches the origin O to allow the print head to finish printing on the slip such that c=d, and then stopping slip transportation.

3. The method of claim 1, wherein operating at least one of the magnetic ink reading unit and the image scanning unit to determine the length of the printing area further comprises detecting the origin O to determine the length of the printing area.

4. The method of claim 2, wherein operating at least one of the magnetic ink reading unit and the image scanning unit to determine the length of the printing area further comprises detecting the origin O to determine the length of the printing area.

5. The method of claim 1, further comprising:

if c is less than d, after stopping slip transportation, advancing a next slip in the plurality of slips into the print media processing apparatus; and if c is greater than or equal to d, after stopping slip transportation, advancing a next slip in the plurality of slips into the print media processing apparatus.

6. The method of claim 2, further comprising:

if c is greater than or equal to d and e is greater than a, after stopping slip transportation, advancing a next slip in the plurality of slips into the print media processing apparatus;

if c is greater than or equal to d and e is less than or equal to a, after stopping slip transportation, advancing a next slip in the plurality of slips into the print media processing apparatus;

if c is less than d and e is greater than a+(d−c), after stopping slip transportation, advancing a next slip in the plurality of slips into the print media processing apparatus; and if c is less than d and e is less than or equal to a+(d−c), after stopping slip transportation, advancing a next slip in the plurality of slips into the print media processing apparatus.

* * * * *